US005553634A

United States Patent [19]

Yang

[11] Patent Number: 5,553,634

[45] Date of Patent: Sep. 10, 1996

[54] COMPACTLY MOLDED RIB MEANS FOR MULTIPLE-FOLD UMBRELLA

[76] Inventor: Chi-Kuo Yang, c/o Hung Hsing Patent Service Center P.O. Box 55-1670, Taipei, Taiwan

[21] Appl. No.: 586,156

[22] Filed: Jan. 17, 1996

[51] Int. Cl.[6] ..... A45B 19/10

[52] U.S. Cl. ..... 135/25.3; 135/31

[58] Field of Search ..... 135/25.1, 25.3, 135/25.31, 26, 31, 25.34, 29

[56] References Cited

U.S. PATENT DOCUMENTS

| | | | |
|---|---|---|---|
| 1,010,089 | 11/1911 | Szabados | 135/25.31 X |
| 1,469,495 | 10/1923 | Bunker | 135/31 X |
| 1,490,924 | 4/1924 | Hartzell | 135/25.31 X |
| 4,966,180 | 10/1990 | Lai | 135/26 X |
| 5,085,239 | 2/1992 | Chin-Hung et al. | 135/31 X |
| 5,267,583 | 12/1993 | Wu | 135/25.1 X |
| 5,390,686 | 2/1995 | Lin et al. | 135/25.1 X |
| 5,392,799 | 2/1995 | Lai | 135/31 X |
| 5,435,331 | 7/1995 | Okuda | 135/31 X |

*Primary Examiner*—Lanna Mai

[57] ABSTRACT

A rib assembly for multiple-fold umbrella includes: a top rib as integrally formed by plastic molding process and pivotally secured to an upper notch of a central shaft and having an upper groove and a lower groove respectively recessed in an upper surface and a lower surface of the top rib, a stretcher rib pivotally secured to a lower runner slidably held on the central shaft and pivotally connected to the top rib, an intermediate rib as integrally formed by plastic molding process and pivotally connected between the top rib and a tail rib and having a web portion integrally formed on the intermediate rib for limiting a spring rib, with the spring rib slidably held in a groove recessed in the intermediate rib and pivotally connected between the tail rib and an auxiliary connecting rib pivotally secured between the stretcher rib and the intermediate rib, whereby upon folding of the rib assembly when closing an umbrella from its opening state, the stretcher rib and the auxiliary connecting rib will be received in the lower groove of the top rib and the intermediate rib and the spring rib will be received in the upper groove of the top rib to greatly minimize a folded volume of the closed umbrella for a convenient handling and storage.

2 Claims, 3 Drawing Sheets

COMPACTLY MOLDED RIB MEANS FOR MULTIPLE-FOLD UMBRELLA

BACKGROUND OF THE INVENTION

A conventional umbrella rib assembly as pivotally secured to a central shaft of a multiple-fold umbrella is generally made of metallic material such as iron or steel, in which a rib may be pressed or processed to form a longitudinal groove from a surface of the rib adapted for receiving another neighbor rib when folding an umbrella in order for reducing the volume of a folded umbrella.

However, a conventional metallic rib is pressed by mechanical processing method to form a single U-shaped groove as recessed from a single side of the rib, rather than double grooves respectively recessed in two opposite sides of the rib. Therefore, a central rib can not receive two neighbor ribs disposed on two opposite sides of the central rib for largely minimizing a folded volume when closing the umbrella from its opening state, thereby being unable to greatly minimize a folded umbrella to be a mini compact structure.

A conventional multiple-fold umbrella as taught by Yang (the same inventor of this application) in his U. S. Pat. No. 4,739,783 and 4,676,262 disclosed a spring rib or link slidably received in a U-shaped rib groove of a base rib requiring a helical spring (as numeral "83" in U. S. Pat. No. 4,739,783) or collar (as numeral "51" in U. S. Pat. No. 4,676,262) formed in the rib groove for limiting the spring rib or link during the sliding movement within the U-shaped groove of the base rib.

However, the helical spring (83) or the collar (51) in the two prior arts shall require, further processing for embedding the helical spring (83) in the rib groove or by pressing the rib to form the collar (51), causing production inconvenience and increasing production cost. If the helical spring (83) is loosened from the base rib or the collar (51) deformed on the base rib, it will lose its effect for limiting the spring link slidably held on the base rib.

The present inventor has found the drawbacks of the conventional umbrella rib assembly and invented the compactly molded rib means.

SUMMARY OF THE INVENTION

The object of the present invention is to provide a rib assembly for multiple-fold umbrella including: a top rib as integrally formed by plastic molding process and pivotally secured to an upper notch of a central shaft and having an upper groove and a lower groove respectively recessed in an upper surface and a lower surface of the top rib, a stretcher rib pivotally secured to a lower runner slidably held on the central shaft and pivotally connected to the top rib, an intermediate rib as integrally formed by plastic molding process and pivotally connected between the top rib and a tail rib and having a web portion integrally formed on the intermediate rib for limiting a spring rib, with the spring rib slidably held in a groove recessed in the intermediate rib and pivotally connected between the tail rib and an auxiliary connecting rib pivotally secured between the stretcher rib and the intermediate rib, whereby upon folding of the rib assembly when closing an umbrella from its opening state, the stretcher rib and the auxiliary connecting rib will be received in the lower groove of the top rib and the intermediate rib and the spring rib will be received in the upper groove of the top rib to greatly minimize a folded volume of the closed umbrella for a convenient handling and storage; and upon the sliding movement of the spring rib in the intermediate rib, the web portion as integrally formed with the intermediate rib will be strong enough for keeping the spring rib well in the groove of the intermediate rib for a reliable sliding movement of the spring rib.

DETAILED DESCRIPTION

Figures 1, 2:
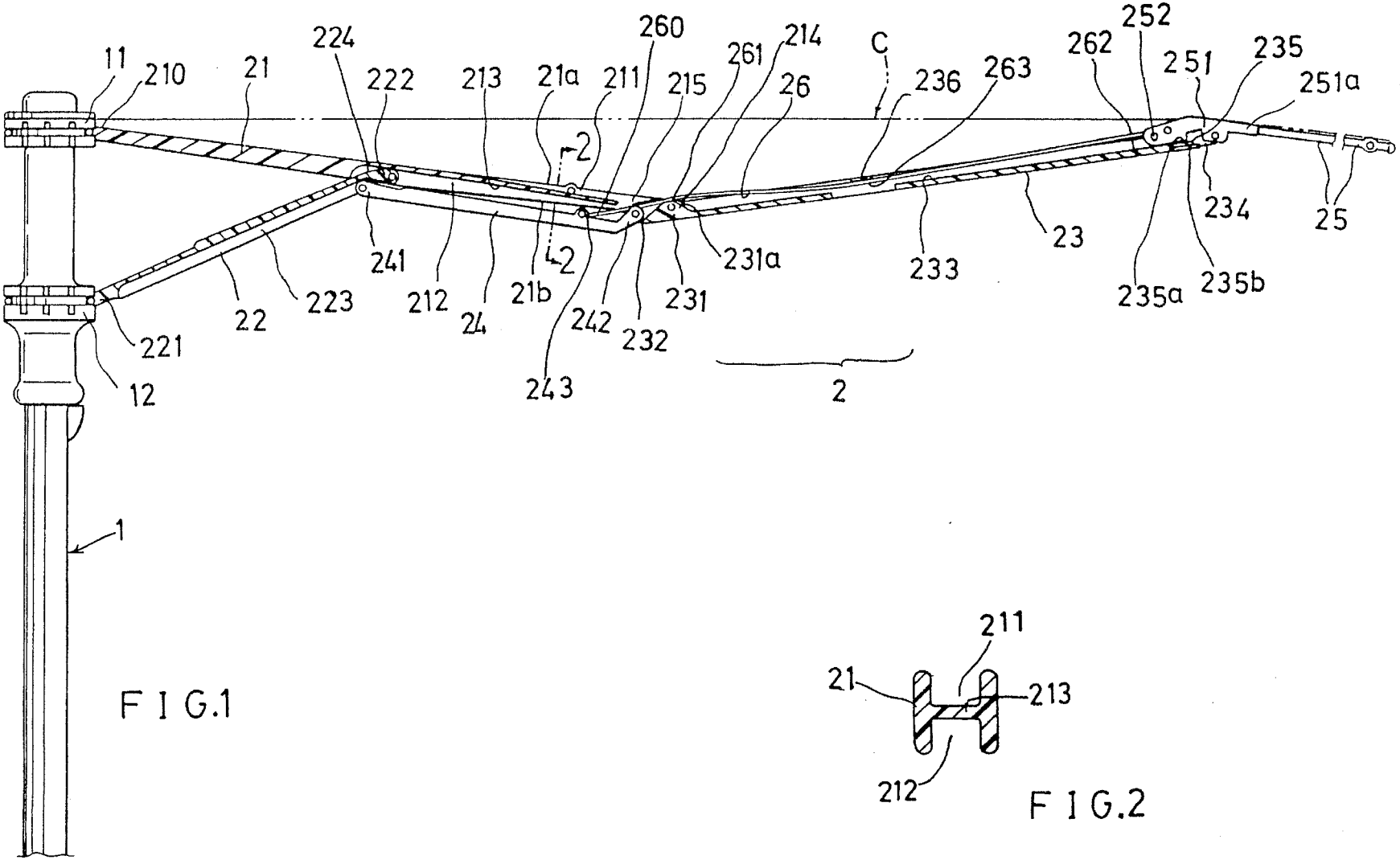
FIG. 1 is an illustration showing an extended rib means when opening the umbrella in accordance with the present invention.
FIG. 2 is a sectional drawing of the top rib as viewed from 2—2 direction of FIG. 1.

As shown in the drawing figures, the present invention comprises: a rib means 2 pivotally secured to an upper notch 11 secured on a top portion of a central shaft 1 and a lower runner 12 slidably held on the central shaft 1.

The rib means 2 for securing an umbrella cloth C thereon includes: a top rib 21 pivotally secured to an upper notch 11 secured on a top portion of the central shaft 1, a stretcher rib 22 pivotally secured to a lower runner 12 slidably held on the central shaft 1 and pivotally secured to a middle portion of the top rib 21, an intermediate rib 23 pivotally secured between the top rib 21 and a tail rib 25 an auxiliary connecting rib 24 generally positioned under the top rib 21 and pivotally secured between the stretcher rib 22 and the intermediate rib 23, and a spring rib (or link) 26 pivotally secured between the auxiliary connecting rib 24 by passing through an outer portion of the top rib 21 and the tail rib 25 to be slidably held in a longitudinal groove 233 in the intermediate rib 23.

The top rib 21 includes: an inner end 210 pivotally secured to the upper notch 11 of the central shaft 1, an outermost end 214 adjacent to an outer fork end 215 of the top rib 21 and pivotally connected with an inner end 231 of the intermediate rib 23, with the outer fork end 215 defining a slot therein for passing an inner spring portion 261 of the spring rib 26 through the slot in the outer fork end 215 of the top rib to allow an innermost spring end 260 of the spring rib 26 to be pivotally secured with an outer end 243 of the auxiliary connecting rib 24 (FIGS. 3, 1); and the intermediate rib 23 includes: an innermost end 232 pivotally secured with an outermost end 242 of the auxiliary connecting rib 24, an outer fork end 234 pivotally connected with an inner pivotal portion 251 of the tail rib 25, and a longitudinal groove 233 recessed in the intermediate rib 23 for slidably holding the spring rib 26 in the longitudinal groove 233.

The stretcher rib 22 includes: an inner end 221 pivotally secured to the lower runner 12 of the central shaft 1, an outermost end 222 pivotally connected with a middle portion of the top rib 21, an outer end 224 adjacent to the outermost end 222 for pivotally connecting an inner end 241 of the auxiliary connecting rib 24, and an outer groove 223 longitudinally recessed in an outer surface of the stretcher rib 22 for receiving the auxiliary connecting rib 24 into the outer groove 223 of the stretcher rib 22 when closing the umbrella for folding the rib means 2.

The tail rib 25 has an innermost end 252 pivotally connected with an outer spring end 262 of the spring rib 26, and a crimping portion 251*a* formed on the inner pivotal portion 251 for crimping an inner portion of the tail rib 25.

The rib means 2 as shown in the drawing figures may be used for a triple-fold umbrella. However, the present invention may be modified to be any multiple-fold umbrellas, not limited in the present invention. The ribs may be made by plastic materials, even though the auxiliary connecting rib 24, the spring rib 26, and the tail rib 25 may be made of metallic materials. However, the materials for making the ribs of this invention are not limited.

The top rib 21 and the intermediate rib 23 are integrally formed by plastic molding process and made of plastic material or reinforced plastic materials, such as fiber-glass reinforced plastic (FRP), carbon-fiber reinforced plastic material and other engineering plastic materials.

The top rib 21 includes: an upper groove 211 longitudinally recessed in an upper surface 21*a* of the top rib 21 for receiving the intermediate rib 23 in the upper groove 211 of the top rib 21 when closing the umbrella and folding the rib means 2 from an opened umbrella, a lower groove 212 longitudinally recessed in a lower surface 21*b* of the top rib 21 for receiving the stretcher rib 22 having the auxiliary connecting rib 24 received in the outer groove 223 recessed in the stretcher rib 22 when closing the umbrella, and a central partition 213 separating the upper groove 211 and the lower groove 212 of the top rib 21, with the upper and lower grooves 211, 212 receiving the intermediate rib 23 and the stretcher rib 22 for greatly minimizing a folded volume when closing the umbrella.

Figure 3:
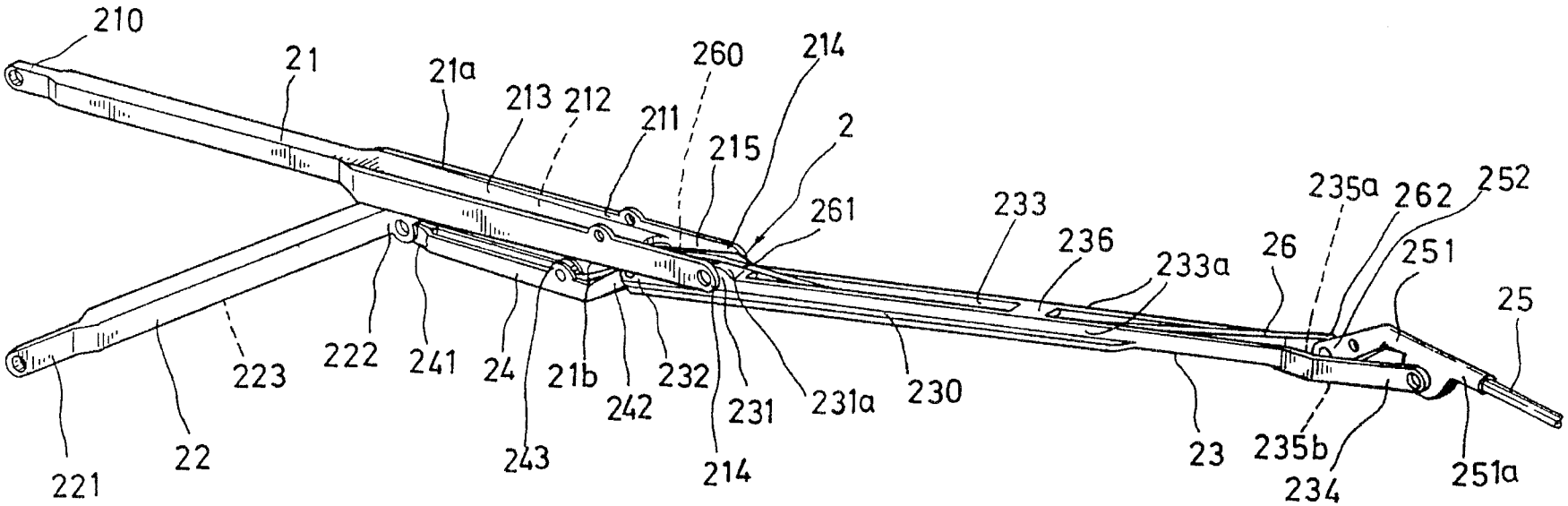
FIG. 3 a perspective view of the present invention.
Figure 5:
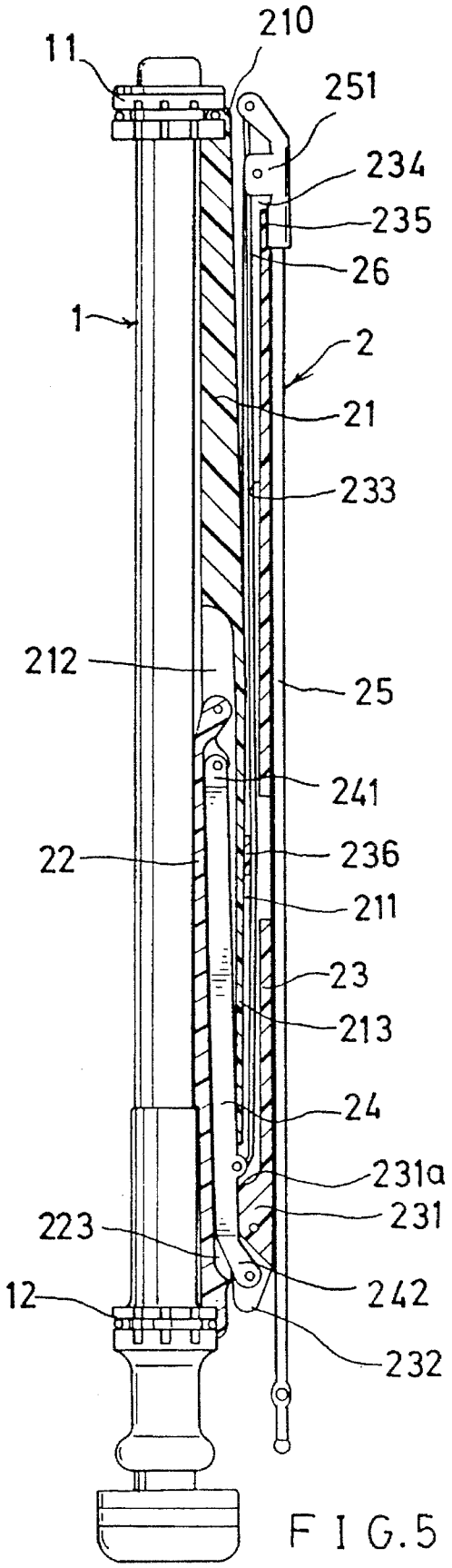
FIG. 5 is a partial sectional drawing of the folded rib means of FIG. 4.
Figure 4:
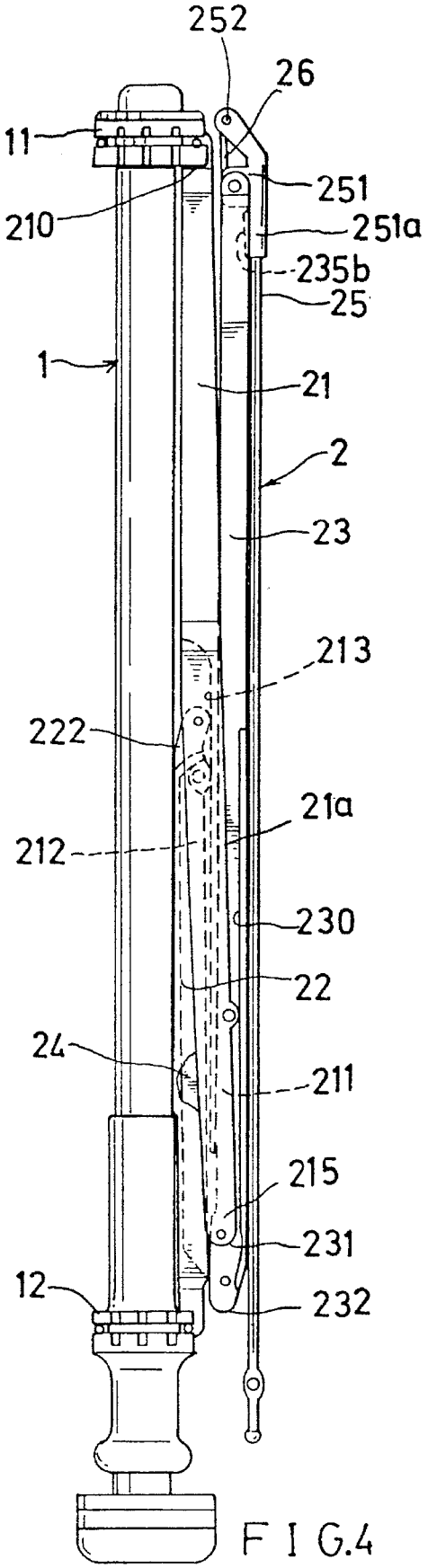
FIG. 4 shows a folded rib means of the present invention.

The intermediate rib 23 includes: a web portion 236 integrally formed on a central upper portion of the intermediate rib 23 and transversely connecting two longitudinal side walls 233*a* confining the longitudinal groove 233 longitudinally recessed in the intermediate rib 23 for limiting a central spring portion 263 of the spring rib 26 slidably held in the longitudinal groove 233 in the intermediate rib 23, an end partition portion 235 formed in the outer fork end 234 of the intermediate rib 23 having an upper recess 235*a* above the end partition 235 for seating an innermost end 252 of the tail rib 25 when opening the umbrella as shown in FIGS. 3 and 1, and having a lower recess 235*b* below the end partition portion 235 for receiving the crimping portion 251*a* of the inner pivotal portion 251 of the tail rib 25 when closing the umbrella or minimizing a folded volume of the closed umbrella.

The intermediate rib 23 further includes: at least a side-wing extension 230 on a lower edge of the intermediate rib 23 for supporting an outermost end 214 of the top rib 21 when opening the umbrella as shown in FIG. 3 for stabilizing an opened umbrella, and a convex portion 231*a* formed on an inner portion of the intermediate rib 23 for supporting an inner spring portion 261 of the spring rib 26 when opening the umbrella (FIGS. 3, 1).

The present invention is superior to a conventional multiple-fold umbrella with the following advantages:

1. The top rib 21 having an upper and a lower groove 211, 212 respectively recessed in two opposite sides of the rib 21 for receiving the neighbor ribs including the stretcher rib 22, the connecting rib 24 positioned at a lower or inner side of the top rib 21, and including the intermediate rib 23 positioned at an upper and outer side of the top rib 21, thereby greatly minimizing a folded volume of a closed umbrella for a convenient handling and storage of the folded umbrella.

2. The web portion 236 is integrally formed on an upper surface of the intermediate rib 23 to limit the spring rib 26 slidably held in the groove 233 in the intermediate rib 23 for a strong and efficient limiting of the spring rib 26 in the intermediate rib 23. Also, the web portion 236 is integrally formed on the rib 23 for saving a mechanical joining or processing job which is required for a conventional collar or spring coil used for limiting the spring rib or link sliding in the groove of the lower rib.

3. The outer portion of the intermediate rib 23 is also formed with an upper and a lower recess 235*a*, 235*b* for stabilizing an tail rib 25 when opening the umbrella, and for receiving the pivotal portion of the tail rib 25 for reducing the folded volume when closing the umbrella.

The present invention maybe modified without departing from the spirit and scope of this invention.

I claim:

1. A rib means for multiple-fold umbrella comprising: a top rib pivotally secured to an upper notch secured on a top portion of a central shaft of an umbrella, a stretcher rib pivotally secured to a lower runner slidably held on the central shaft and pivotally secured to the top rib, an outer groove recessed in the stretcher rib, an intermediate rib pivotally secured between the top rib and a tail rib, an auxiliary connecting rib generally positioned under the top rib and pivotally secured between the stretcher rib and the intermediate rib with said auxiliary connecting rib received in said outer groove in said stretcher rib when closing an umbrella and folding the rib means, and a spring rib pivotally secured between the auxiliary connecting rib and the tail rib to be slidably held in a longitudinal groove in the intermediate rib; the improvement which comprises:

said top rib including: an upper groove longitudinally recessed in an upper surface of the top rib for receiving the intermediate rib when closing the umbrella and folding the rib means from an opened umbrella, a lower groove longitudinally recessed in a lower surface of the top rib for receiving the stretcher rib and a central partition separating the upper groove and the lower groove of the top rib; and said intermediate rib including: a web portion integrally formed on a central upper portion of the intermediate rib and transversely connecting two longitudinal side walls confining the longitudinal groove longitudinally recessed in the intermediate rib for limiting a central spring portion of the spring rib slidably held in the longitudinal groove in the intermediate rib, an end partition portion formed in an outer fork end of the intermediate rib having an upper recess above the end partition for seating an innermost end of the tail rib when opening the umbrella, and having a lower recess below the end partition portion for receiving an inner pivotal portion of the tail rib when closing the umbrella for minimizing a folded volume of a closed umbrella; with said top rib and said intermediate rib integrally formed and made of plastic material.

2. A rib means according to claim 1, wherein said intermediate rib includes: at least a side-wing extension on a lower edge portion of the intermediate rib for supporting an outermost end of the top rib when opening the umbrella for stabilizing an opened umbrella, and a convex portion formed on an inner portion of the intermediate rib for supporting an inner spring portion of the spring rib when opening the umbrella.

* * * * *